US005081904A

United States Patent [19]

Horn et al.

[11] Patent Number: 5,081,904

[45] Date of Patent: Jan. 21, 1992

[54] LOCKING VALVE AND FLOW CONTROL VALVE ASSEMBLY

[75] Inventors: Edward R. Horn, Oconomowoc; Derek Hopkinson, Menomonee Falls; Michael C. Allen, Pewaukee, all of Wis.

[73] Assignee: Aladdin Engineering & Mfg., Inc., Brookfield, Wis.

[21] Appl. No.: 590,600

[22] Filed: Sep. 25, 1990

Related U.S. Application Data

[63] Continuation of Ser. No. 400,331, Aug. 30, 1989, abandoned.

[51] Int. Cl.[5] ..... F15B 13/04

[52] U.S. Cl. ..... 91/420; 91/443; 91/447

[58] Field of Search ..... 91/420, 443, 447

[56] References Cited

U.S. PATENT DOCUMENTS

| | | | |
|---|---|---|---|
| 2,959,188 | 11/1960 | Kepner | 137/540 |
| 3,229,721 | 1/1966 | Bingel | 137/625.69 |
| 3,335,750 | 8/1967 | Kepner | 137/515.5 |
| 3,792,715 | 2/1974 | Parrett et al. | 137/493 |
| 3,817,154 | 6/1974 | Martin | 91/420 |
| 3,975,987 | 8/1976 | Panis | 91/420 |
| 3,980,336 | 9/1976 | Bitonti | 298/23 |
| 4,018,136 | 4/1977 | Kaetterhenry | 91/420 |
| 4,073,311 | 2/1978 | McGeachy | 91/443 X |
| 4,103,699 | 8/1978 | Vik | 91/420 X |
| 4,171,007 | 10/1979 | Bouteille | 137/599 |
| 4,172,582 | 10/1979 | Bobnar | 251/63 |
| 4,192,338 | 3/1980 | Gerulis | 137/106 |
| 4,287,812 | 9/1981 | Iizumi | 91/420 |
| 4,531,449 | 7/1985 | Reith | 91/420 |
| 4,624,445 | 11/1986 | Putnam | 91/420 X |
| 4,742,849 | 5/1988 | Prudhomme et al. | 91/443 X |
| 4,838,306 | 6/1989 | Horn et al. | 91/420 X |

OTHER PUBLICATIONS

Hydraulic and Pneumatic Check and Relief Check Valves author, Kepner Products Company, 995 N. Ellsworth Avenue Villa Park, IL 60181.

*Primary Examiner*—Gerald A. Michalsky
*Attorney, Agent, or Firm*—Michael, Best & Friedrich

[57] ABSTRACT

A locking valve for selectively locking fluid pressure in a fluid cylinder in the event of failure of the source of fluid pressure to the cylinder and including an integral fluid flow control valve, the locking valve also including a fluid pressure seal between the fluid supply port and the pilot port of the locking valve to prevent back pressure on the pilot pressure operated valve components.

12 Claims, 1 Drawing Sheet

LOCKING VALVE AND FLOW CONTROL VALVE ASSEMBLY

This is a continuation of U.S. patent application Ser. No. 07/400,331, filed Aug. 30, 1989 now abandoned.

FIELD OF THE INVENTION

The invention relates to pneumatically or hydraulically operated cylinders and more particularly to a valve assembly for use in locking fluid in a cylinder, the locking valve assembly including means for manually overriding the locking valve to permit release of fluid from the locking valve.

A pneumatic locking valve with manual override is illustrated in applicant's U.S. Pat. No. 4,838,306 issued June 13, 1989.

BACKGROUND PRIOR ART

A prior art locking valve for use primarily with hydraulic cylinders is illustrated in a catalog titled *Hydraulic and Pneumatic Check and Relief Check Valves* published by Kepner Products Co., Villa Park, Ill. Those prior art locking valves are pilot operated such that release of the locking valves requires application of fluid pressure to a pilot port of the locking valve. Such locking valves do not permit release of the locking valve in the absence of a fluid pressure source.

A prior art flow-control valve for use primarily with pneumatic cylinders is illustrated in a catalog published by Legris, Inc., Rochester, N.Y.

Attention is also directed to the following U.S. patents:

| NAME | U.S. PAT. NO. | ISSUE DATE |
|---|---|---|
| Kepner | 2,959,188 | 11/8/60 |
| Kepner | 3,335,750 | 8/15/67 |
| Kaetterhenry | 4,018,136 | 4/19/77 |
| Panis | 3,975,987 | 8/24/76 |
| Gerulis | 4,192,338 | 3/11/80 |
| Bobnar | 4,172,582 | 10/30/79 |
| Bitonti | 3,980,336 | 9/14/76 |
| Martin | 3,817,154 | 6/18/75 |
| Parrett et al. | 3,792,715 | 2/19/74 |
| Reith | 4,531,449 | 7/30/85 |
| Bingel | 3,229,721 | 1/18/66 |

SUMMARY OF THE INVENTION

The present invention provides an improved apparatus for providing a means for selectively locking fluid pressure in a fluid cylinder in the event of failure of the source of fluid pressure to the cylinder and including means for providing for convenient manual override of the locking mechanism to permit fluid flow from the cylinder. The apparatus embodying the invention also provides a locking valve configuration and manual override means having a configuration which is economically manufactured and adapted for use in various applications. The apparatus embodying the invention also provides a flow control valve configuration and manual flow control adjustment means.

More particularly, the apparatus embodying the invention includes the combination of a locking valve and a flow control valve, and with the apparatus including a locking valve assembly body, the body housing both the locking valve and the flow control valve in integrated relation.

More particularly, the invention includes a fluid cylinder assembly including a cylinder having one end including an advance port and an opposite end including a retract port, a piston housed in the cylinder and supported therein for shiftable movement between an extended position and a retracted position, and means for selectively and alternatively supplyinq fluid pressure to the advance port and the retract port of the fluid cylinder to provide for reciprocal movement of the piston.

The apparatus also includes means for preventing discharge of fluid from the advance port of the cylinder in the event of interruption in the supply of fluid between the fluid pressure source and the cylinder, the means for preventing discharge including a valve member for selectively blocking flow of fluid pressure from the cylinder in the event the supply of fluid pressure is interrupted, and manually operable means for forcing the valve member to a position wherein fluid pressure is vented from the cylinder.

In one embodiment of the invention the means for selectively locking fluid in the cylinder includes a locking valve body having a locking valve bore, a first portion of the locking valve bore being in communication with the source of fluid pressure, and a second portion of the locking valve bore communicating with one end of the cylinder whereby fluid can be supplied to the cylinder to cause movement of the piston in the first direction, a locking valve seat between the first portion of the locking valve bore and the second portion of the locking valve bore, a locking valve member selectively engageable with the locking valve seat, and means for resiliently biasing the locking valve member against the locking valve seat to releasably prevent fluid flow from the fluid pressure source to the first end of the cylinder.

In one embodiment of the invention means are provided for forcing the locking valve member away from the locking valve seat, this structure including a valve cylinder, located in a third portion of the locking valve bore, and a plunger partially housed in the locking valve cylinder, the plunger being adapted on one end to selectively engage the locking valve member to force the locking valve member away from the locking valve seat, and an opposite end of the plunger comprising a plunger piston, and means for preventing the movement of fluid from the first portion of the locking valve bore to the third portion of the locking valve bore, and means for providing fluid communication between the opposite end of the cylinder and the valve cylinder on one side of the plunger piston.

In one embodiment of the invention the means for manually forcing the locking valve member away from the locking valve seat includes a manually movable override member having one end adapted to engage the plunger to force the plunger into engagement with the locking valve member to move the locking valve member away from the locking valve seat, and an opposite end extending from the end of the locking valve body and adapted to be manually engaged whereby the manually movable member can be forced against the plunger to cause the plunger to move the locking valve member away from the locking valve seat.

Various other features and advantages of the invention will be apparent by reference to the following description of a preferred embodiment, from the claims and from the drawings.

Figure 1:
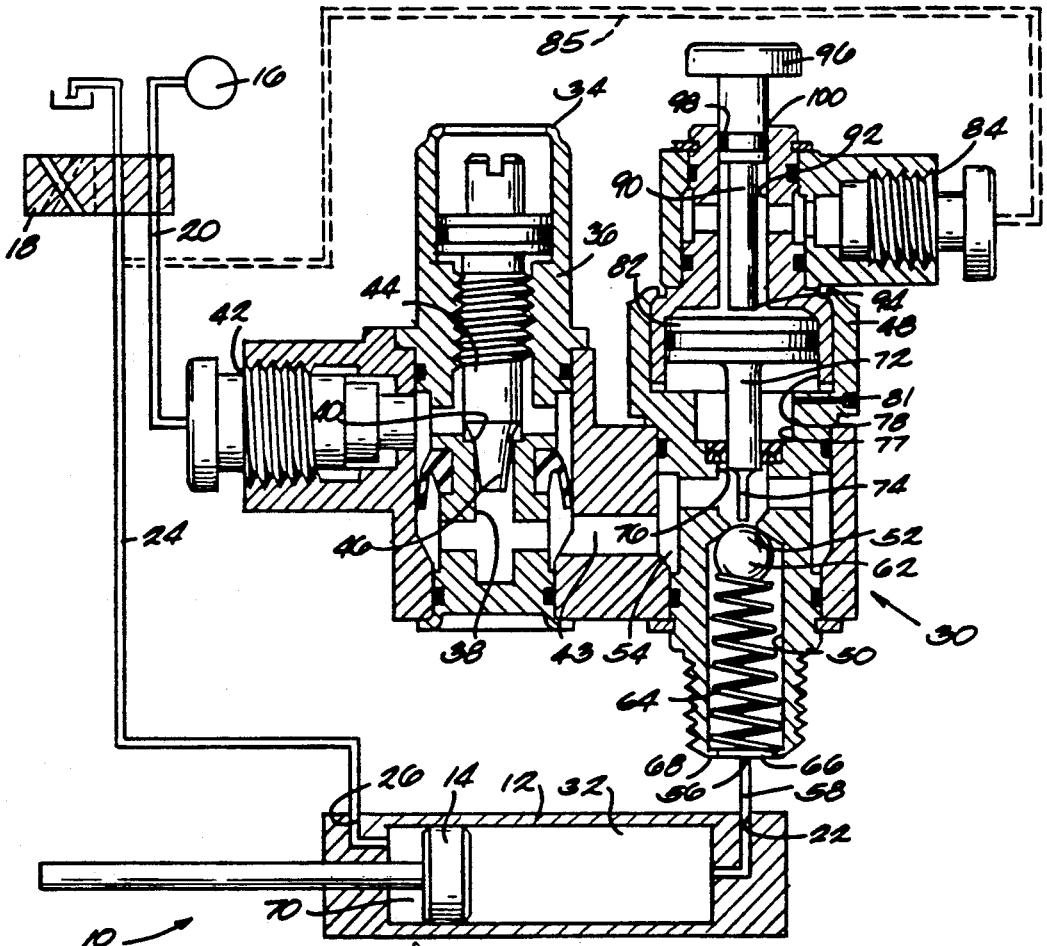
FIG. 1 is a side elevational view, partially in section, of a locking valve assembly embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 is a fluid operated cylinder assembly 10 embodying the invention and including a fluid cylinder 12 housing a piston 14. While it will be appreciated that the cylinder 12 could be a hydraulic cylinder, in the illustrated arrangement, the cylinder assembly is pneumatic. The cylinder assembly further includes a pneumatic pump 16 operably connected through a four-way valve 18 to the cylinder. A fluid line 20 provides for air flow from the valve 18 to an advance port 22 of the cylinder 12 and a fluid line 24 provides for air flow from the valve 18 to the return port 26 of the cylinder.

Also included in the pneumatic circuit is a locking valve assembly 30 operably connected to the ports 22 and 26 of the pneumatic cylinder 12 and functioning to selectively lock air in the cylinder 12 and thereby prevent exhaust of air from that port in the event of a failure of the source of air pressure supplied to the cylinder 12 as a result of either a failure of the air pump 16, failure of the control valve 18, or a failure of the air line. While in the illustrated arrangement the locking valve assembly is shown connected to the port 22 to selectively lock air in the advance end of the cylinder, in other applications the locking valve assembly could be connected to port 26 to selectively prevent air from being discharged from that port.

While various locking valve assembly constructions may be used, in the disclosed construction the locking valve assembly 30 comprises a locking valve assembly body with first and second cylindrical bores. The locking valve assembly further comprises a cylindrical flow control valve cartridge which is housed in the first cylindrical bore, and a cylindrical locking valve cartridge which is housed in the second cylindrical bore, and conventional sealing means, such as O-rings, for preventing air flow between the mating surfaces of the cylindrical valve cartridges and the valve assembly body. The sealing means are positioned in annular grooves in the cylinder valve cartridges.

The locking valve assembly 30 includes a flow control valve 34 having a flow control valve body 36. The flow control valve body 36 includes a flow control valve bore 38 having a flow control valve seat 40 intermediate the opposite ends of the valve bore 38. An air inlet port 42 provides fluid communication between the air line 20 and the flow control valve bore 38, and intersects the valve bore 38 on one side of the flow control valve seat 40, and an air outlet port 43 intersects the valve bore on an opposite side of the valve seat 40.

The flow control valve 34 also includes a flow control valve member 44 housed in the flow control valve bore and having an end 46 adjustably engageable with the flow control valve seat 40 to control fluid flow from the air inlet port 42, across the valve seat 40, to the air outlet port 43. To facilitate adjustment of the position of the end 46 of the valve member 44 with respect to valve seat 40, the valve member includes a threaded portion threadably housed in a threaded bore, and a slotted head for engagement with a tool, such as a screwdriver.

The locking valve assembly 30 also includes a locking valve body 48 including a valve bore 50 extending longitudinally through the locking valve body 48 and having a locking valve seat 52 intermediate the opposite ends of the locking valve bore 50. An air inlet port 54 provides fluid communication between the flow control valve air outlet port 43 and the locking valve bore 50, and intersects the locking valve bore on one side of the valve seat 52, and an air pressure supply port 56 intersects the locking valve bore on an opposite side of the valve seat 52, and is adapted to be connected by an air line 58 to the advance port 22 of the air cylinder 12.

The locking valve assembly 30 also includes a locking valve member 62 housed in the locking valve bore 50 and selectively engageable with the valve seat 52 to control fluid flow from the air inlet port 54 through the valve seat 52 to the air supply port 56. While the locking valve member 62 could have other constructions, in the illustrated arrangement it comprises a ball. A compression spring 64 is housed in the locking valve bore 50 and biases the ball 62 against the valve seat 52. The end of the compression spring 64 opposite that end engaging the ball 62 is supported by an inwardly projecting shoulder 66 fixed in an end 68 of the locking valve bore 50.

While in the illustrated arrangement, the valve member 62 is shown as comprising a ball, in other arrangements the valve member could have other configurations and other conventional seating actions.

The locking valve assembly further includes means for moving the ball valve 62 away from the locking valve seat 52 when air pressure is supplied to the return port 26 of the cylinder 12 and to thereby provide for exhaust of air from the advance side 32 of the cylinder 12 through the valve seat 52, and through the flow control valve 34, and through the air line 20 and the control valve 18 to atmosphere. The air pressure in the return side 70 of the cylinder 12 will then cause retraction of the piston. This means for moving the ball 62 away from the valve seat 52 includes a pilot operated plunger 72 having an end 74 housed in a portion 76 of the locking valve bore and engageable with the locking valve member 62 to selectively force the valve member 62 away from the valve seat 52.

Figure 3:
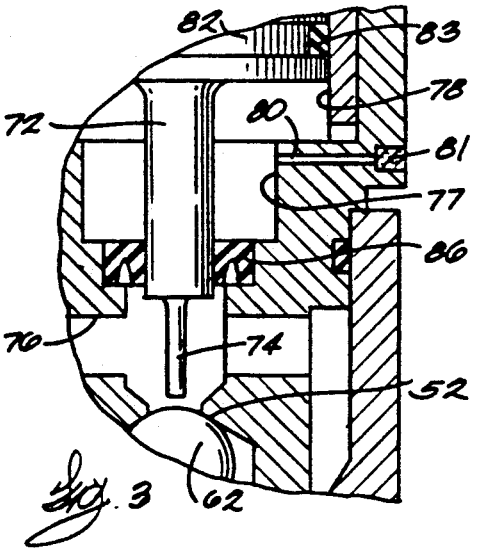
FIG. 3 is an enlarged portion of FIG. 1, showing sealing and venting means.
Figure 2:
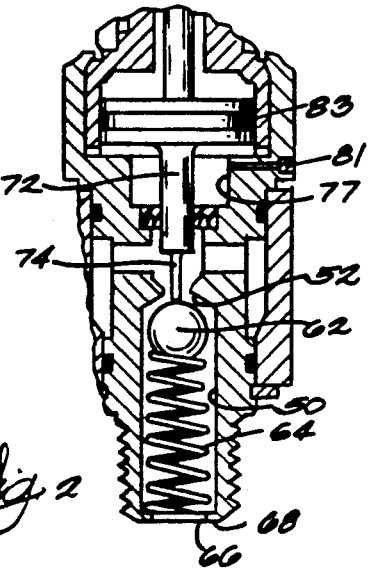
FIG. 2 is an enlarged portion of FIG. 1, showing the valve member in an unseated position.

The end of the locking valve bore 50 opposite that end including the locking valve seat 52 defines a chamber containing three sections defining two cylinders. The first cylinder 77 contains an air vent passage 80 (FIG. 3) permitting the exhaust of air from the first cylinder 77 and the second cylinder 78. A porous filter 81 is housed in the outer end of the passage 80 to prevent contaminants from entering passage 80. The plunger 72 has attached thereto a plunger piston 82, housed in the second cylinder 78. A piston ring 83 surrounds the piston 82 to provide a fluid tight seal with the locking valve cylinder 78. The locking valve body 48 also includes a return air pilot port 84 connected to the return port 26 of the cylinder 12 such that air pressure in the return line 24 will apply a force on the piston 82 causing the end 74 of the plunger 72 to move into engagement with the ball 62 to force the ball 62 away from the valve seat 52. A seal 86 prevents flow of air from the portion 76 of the locking valve bore 50 to the first cylinder 77 of the locking valve bore 50. The seal 86 is at least partially encased in the locking valve body 48 between locking valve bore cylinder 77 and locking valve bore portion 76.

The apparatus embodying the invention further includes means for permitting manual movement of the ball 62 away from the locking valve seat 52 to thereby provide means for manually releasing the pressure in the advance side 32 of the cylinder 12 in the event of a failure of the air pump 16 or other air pressure source and the consequent absence of air pressure in the return air pilot port 84. This means includes a manually movable release plunger 90 housed in section 92 of the locking valve bore 50 and includes an end 94 engageable with the piston head 82 of the plunger 72 to force the plunger 72 into engagement with the ball valve 62. The opposite end of the manually movable release member 90 includes a head 96 extending outward from the locking valve body 48. A seal 98 is provided to prevent leakage of fluid from the locking valve bore 50 through the aperture containing the head 100.

Various features of the invention are set forth in the following claims.

We claim:

1. A locking valve assembly for inhibiting the movement of a piston of a fluid cylinder upon interruption of a source of fluid pressure supplied to the fluid cylinder, and wherein the fluid cylinder includes first and second ports and slideably houses the piston for movement between extended and retracted positions, and wherein the source of fluid pressure alternately is supplied to the first and second ports, the locking valve assembly comprising:

a flow control valve, including a flow control valve body having an inlet port in fluid communication with the source of fluid pressure and an outlet port, the flow control valve being adapted to control the fluid flow from the first port of the fluid cylinder and to the second port of the fluid cylinder;

a locking valve body having a locking valve bore and wherein the locking valve bore includes first, second, and third portions, the flow control valve body and the locking valve body being joined together with the first portion of the locking valve bore being in fluid communication with the flow control valve outlet port, the second portion of the locking valve bore being in fluid communication with both the first portion of the locking valve bore and with the first port of the fluid cylinder, and the third portion of the locking valve bore being in fluid communication with both the first portion of the locking valve bore and with the second port of the fluid cylinder, and a locking valve seat between the first and second portions of the locking valve bore;

a locking valve member moveably housed in the second portion of the locking valve bore and selectively engageable with the locking valve seat to prevent fluid flow between the first portion of the locking valve bore and the second portion of the locking valve bore;

means for biasing the locking valve member against the locking valve seat;

a plunger moveably housed in the first portion of the locking valve bore and selectively engageable with the locking valve member to push the locking valve member away from the locking valve seat;

a plunger piston slideably and sealingly housed in the third portion of the locking valve bore, the plunger piston urging the plunger into engagement with the locking valve member when the source of fluid pressure is supplied to the second port of the fluid cylinder thereby urging the locking valve member away from the locking valve seat.

2. A locking valve assembly as set forth in claim 1 and further including:

a manually moveable release plunger slideably and sealingly mounted in the third portion of the locking valve bore and disposed in force transmitting relation to the plunger piston, the manually moveable release plunger being operable to be manually engaged whereby the release plunger forces the plunger to move the locking valve member away from the locking valve seat thereby allowing fluid flow from the second portion of the locking valve bore to the first portion of the locking valve bore.

3. A locking valve assembly as set forth in claim 1 wherein the flow control valve body includes:

a flow control valve bore, the flow control valve bore including a flow control valve seat, a first portion of the flow control valve bore disposed on one side of the flow control valve seat being in fluid communication with the source of fluid pressure, and a second portion of the flow control valve bore on the other side of the flow control valve seat being in fluid communication with the outlet port;

a flow control valve member housed in the flow control valve bore and engageable with the flow control valve seat.

4. A flow control valve member as set forth in claim 3, wherein the flow control valve member further includes means for controllably adjusting the position of the flow control valve member toward and away from the flow control valve seat to control fluid flow.

5. A locking valve assembly as set forth in claim 1 and further including means for joining the flow control valve body to the locking valve body such that the flow control valve body is rotatable with respect to the locking valve body.

6. A locking valve assembly for inhibiting the movement of a piston of a fluid cylinder upon interruption of a source of fluid pressure supplied to the fluid cylinder, and wherein the fluid cylinder includes first and second ports and slideably houses the piston for movement between extended and retracted positions, and wherein the source of fluid pressure alternately is supplied to the first and second ports, the locking valve assembly comprising:

a flow control valve, including a flow control valve body having an inlet port in fluid communication with the source of fluid pressure and an outlet port, the flow control valve being adapted to control the fluid flow from the first port of the fluid cylinder and to the second port of the fluid cylinder;

a locking valve body having a locking valve bore and wherein the locking valve bore includes first, second, and third portions, the first portion of the locking valve bore being in fluid communication with the source of fluid pressure, the second portion of the locking valve bore being in fluid communication with both the first portion of the locking valve bore and with the first port of the fluid cylinder, and the third portion of the locking valve bore being in fluid communication with both the first portion of the locking valve bore and with the second port of the fluid cylinder, and a locking valve seat between the first and second portions of the locking valve bore;

a locking valve member moveably housed in the second portion of the locking valve bore and selectively engageable with the locking valve seat to prevent fluid flow between the first portion of the locking valve bore and the second portion of the locking valve bore;

means for biasing the locking valve member against the locking valve seat;

a plunger moveably housed in the first portion of the locking valve bore and selectively engageable with the locking valve member to push the locking valve member away from the locking valve seat;

means for preventing flow of fluid from the first portion of the locking valve bore into the third portion of the locking valve bore, sealingly housed in the locking valve bore;

a plunger piston slideably and sealingly housed in the third portion of the locking valve bore, the plunger piston urging the plunger into engagement with the locking valve member when the source of fluid pressure is supplied to the second port of the fluid cylinder thereby urging the locking valve member away from the locking valve seat.

7. A locking valve assembly as set forth in claim 6 and further including:

a manually moveable release plunger slideably and sealingly mounted in the third portion of the locking valve bore and disposed in force transmitting relation to the plunger piston, the manually moveable release plunger being operable to be manually engaged whereby the release plunger forces the plunger to move the locking valve member away from the locking valve seat thereby allowing the movement of fluid from the second portion of the locking valve bore to the first portion of the locking valve bore.

8. A locking valve assembly as set forth in claim 6, wherein the locking valve body further includes a passageway for venting fluid from the third portion of the locking valve bore, the passageway being located between the plunger piston and the first portion of the locking valve bore.

9. A locking valve assembly as set forth in claim 6 wherein the means for preventing flow of fluid from the first portion of the locking valve bore into the third portion of the locking valve bore includes a seal surrounding the plunger in sealing engagement and also engaging the locking valve bore.

10. A locking valve assembly as set forth in claim 6, wherein the flow control valve body includes:

a flow control valve bore, the flow control valve bore including a flow control valve seat, a first portion of the flow control valve bore disposed on one side of the flow control valve seat being in fluid communication with the source of fluid pressure, and a second portion of the flow control valve bore on the other side of the flow control valve seat being in fluid communication with the outlet port;

a flow control valve member housed in the flow control valve bore and engageable with the flow control valve seat.

11. A flow control valve member as set forth in claim 10, wherein the flow control valve member further includes means for controllably adjusting the position of the flow control valve member toward and away from the flow control valve seat to control fluid flow.

12. A locking valve assembly as set forth in claim 6 and further including means for joining the flow control valve body to the locking valve body such that the flow control valve body is rotatable with respect to the locking valve body.

* * * * *